US005904326A

United States Patent [19]

Riu

[11] Patent Number: 5,904,326

[45] Date of Patent: May 18, 1999

[54] BAG HOLDER

[76] Inventor: Wei Tz Riu, 8F, No. 12-1, Din Her Street, San Min Chu, Kaoshiung, Taiwan

[21] Appl. No.: 09/017,491

[22] Filed: Feb. 2, 1998

[51] Int. Cl.[6] ..... A63B 55/00

[52] U.S. Cl. ..... 248/96; 248/97

[58] Field of Search ..... 248/96, 97, 95, 248/146

[56] References Cited

U.S. PATENT DOCUMENTS 5,816,544 10/1998 Hsieh ..... 248/96

5,829,719 11/1998 Han ..... 248/96

*Primary Examiner*—Leslie A. Braun

*Assistant Examiner*—Willie Berry, Jr.

[57] ABSTRACT

A holder includes a frame having a pair of rods and a shaft secured on top of the rods, and a support for supporting an object. The support has an upper end pivotally coupled to the shaft and having two lower openings. A stay has a pair of barrels slidably engaged on the rods and an axle secured between the barrels and a pair of beams having a one end pivotally coupled to the axle. The lower end of the support may be moved away from the coupler for spacing the other ends of the beams away from each other to an open position when the barrels are moved downward along the rods.

7 Claims, 3 Drawing Sheets

BAG HOLDER

BACKGROUND OF THE INVENTION

1. Field of the Invention

The present invention relates to a holder, and more particularly to a bag holder.

2. Description of the Prior Art

Typical bags for receiving game rackets, such as tennis rackets, badminton rackets etc., are normally randomly disposed on the ground and may thus be stepped by the other people inadvertently. In addition, the user have to bow his head for fetching the game rackets received in the bag.

The present invention has arisen to mitigate and/or obviate the afore-described disadvantages of the conventional bags.

SUMMARY OF THE INVENTION

The primary objective of the present invention is to provide a bag holder for supporting the bag in place and for allowing the user to easily fetch the object received in the bag.

In accordance with one aspect of the invention, there is provided a holder comprising a frame including a pair of rods and including a shaft provided on top of the rods, a support for supporting an object, the support including an upper end pivotally coupled to the shaft and including a lower end having a pair of openings, and a stay including a pair of barrels slidably engaged on the rods and an axle secured between the barrels, a coupler pivotally coupled to the axle, and a pair of beams having a first end pivotally coupled to the coupler and each having a second end. The lower end of the support is caused to move away from the coupler for spacing the second ends of the beams away from each other and for opening the holder to an open position when the barrels are moved downward along the rods. The object, particularly a bag for receiving game rackets, such as tennis rackets or badminton rackets, may thus be stably attached to and supported in place by the support of the bag holder and may thus be prevented from being stepped by the others inadvertently. In addition, the user may easily fetch the game rackets received in the bag holder without bowing their heads.

The rods including an upper end, the frame includes a pair of legs having an upper end pivotally coupled to the upper end of the rods and each having a lower end, and includes means for coupling the lower ends of the legs to the rods. The frame includes a slide slidably engaged on the rods and adapted to be moved up and down along the rods, and a pair of links pivotally coupling the lower ends of the legs to the slide for allowing the lower ends of the legs to be moved away from the rods when the slide is moved downward along the rods. A spring biasing means is further provided for biasing the slide upward along the rods and toward the shaft.

The frame includes an upper portion having a stop for engaging with the axle and for retaining the holder in a folded position when the barrels are moved upward toward the shaft.

The lower end of the support includes a stick, the frame includes a lower portion having a retainer for engaging with the stick and for retaining the holder in a folded position when the stick is moved toward the retainer.

The stay includes a bar secured between the barrels, the frame includes a lower end having a hook for engaging with the bar of the stay and for retaining the holder in the open position.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
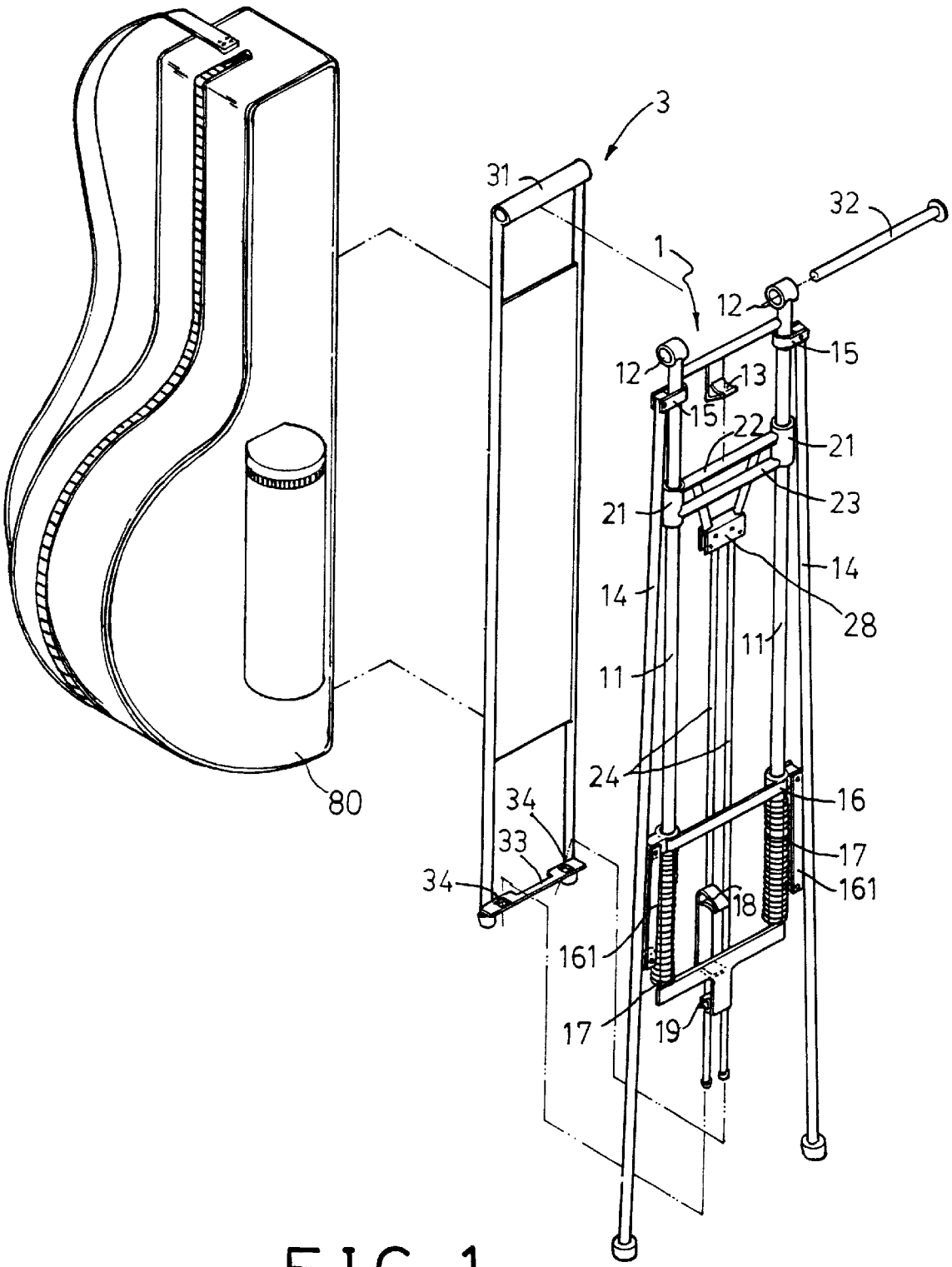
FIG. 1 is a partial exploded view of a bag holder in accordance the present invention.
Figure 2:
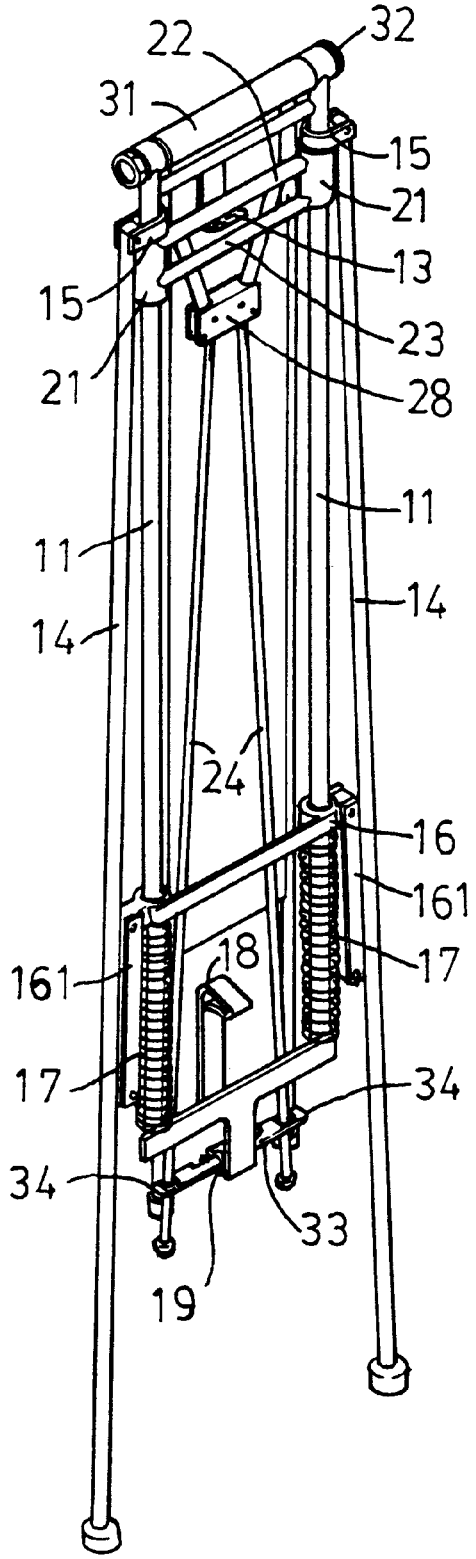
FIG. 2 is a perspective view of the bag holder, in which the bag holder is folded to the storing position.
Figure 3:
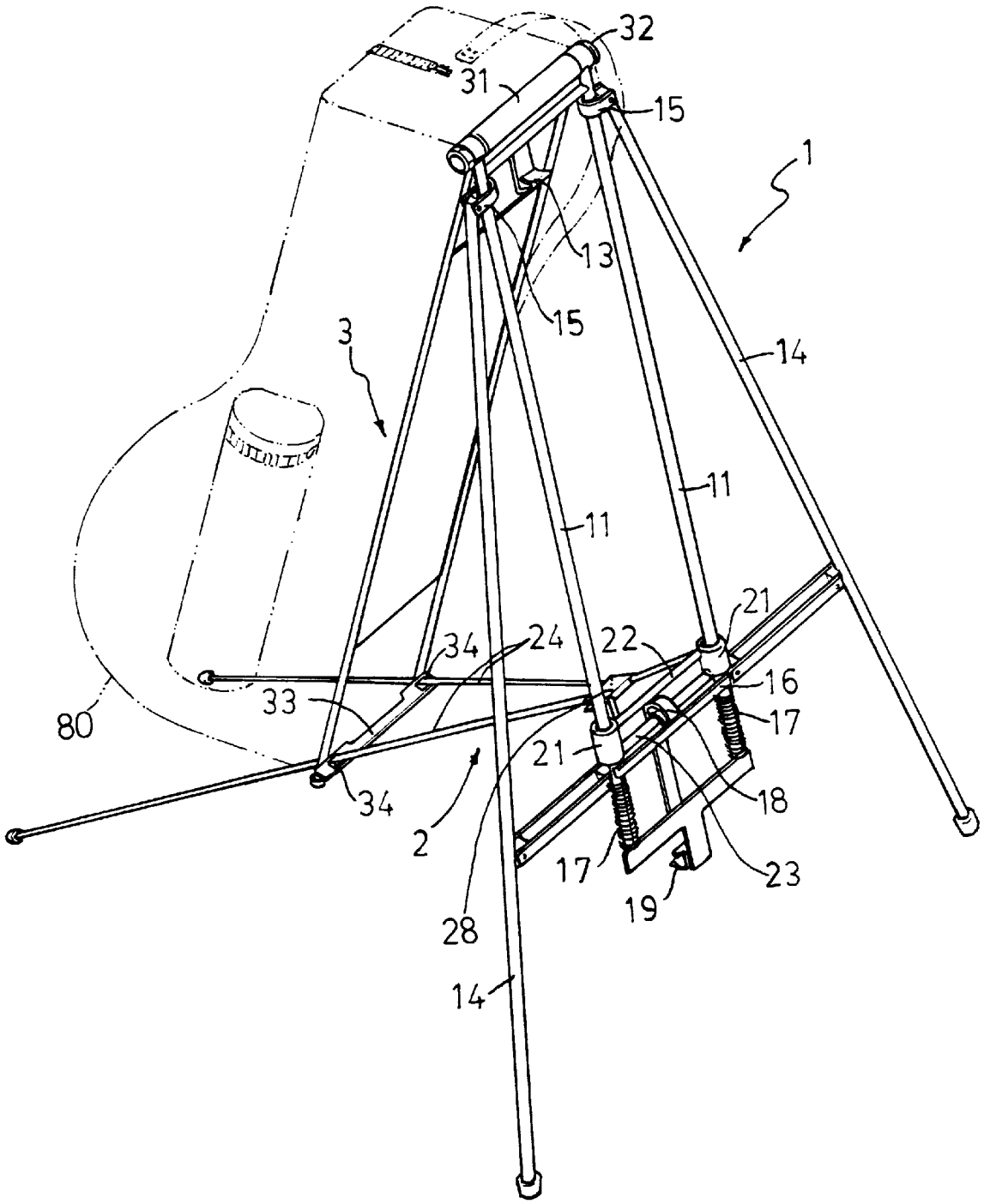
FIG. 3 is a perspective view of the bag holder, in which the bag holder is opened to the working position.

Referring to FIGS. 1–3, a bag holder in accordance with the present invention comprises a frame 1, a stay 2 and a support 3 for supporting a bag 80 or the like. The frame 1 includes a pair of rods 11 each having a sleeve 12 provided on top for rotatably engaging with a shaft 32. The frame 1 includes a stop 13 provided on top and includes a hook 18 and a retainer 19 provided in the lower portion. A pair of legs 14 each has an upper portion pivotally coupled to the upper portion of the rod 11 by a joint 15 for allowing the legs 14 to be rotated relative to the frame 1 about the joints 15. A slide 16 is slidably engaged on the rods 11. A pair of springs 17 are engaged on the rods 11 and engaged with the slide 16 for biasing the slide 16 upward. A pair of links 161 are pivotally coupled between the legs 14 and the slide 16 for limiting the relative rotational movement of the legs 14 relative to the frame 1 about the joints 15.

The stay 2 includes a pair of barrels 21 slidably engaged on the rods 11 and an axle 22 and a bar 23 secured between the barrels 21. A coupler 28 is pivotally secured to the axle 22. A pair of beams 24 have one end pivotally coupled to the coupler 28. The support 3 includes a tube 31 provided on top and rotatably secured to the shaft 32 for allowing the support 3 to be rotated about the shaft 32. The support 3 includes a stick 33 provided on the bottom portion and having two openings 34 for slidably engaging with the beams 24. The free end portions or the lower end portions of the beams 24 may be spaced away from each other when the stick 33 is moved away from the coupler 28 for allowing the beams 24 and the legs 14 to form a stable structure. The bag 80 may be attached to the support 3 by such as adhesive materials, hook and loop devices, fastening belts, fastening hooks, or the like. The support 3 may also includes a bottom panel or board for supporting the bag 80 or other objects.

In operation, as shown in FIG. 2, the barrels 21 of the stay 2 may be moved upward along the rods 11 until the axle 22 is engaged with the stop 13 which may maintain the bag holder in the folded position as shown in FIG. 2. The retainer 19 may engage with the stick 33 for stably retaining the support 3 in place. When the axle 22 is disengaged from the stop 13 and when the barrels 21 are moved downward along the rods 11, the slide 16 may be moved downward against the springs 17 by the barrels 21 until the bar 23 is engaged with the hook 18 which may retain the bag holder in the open position as shown in FIG. 3. When the barrels 21 move downward along the rods 11, the stick 33 will be caused to move away from the coupler 28 so as to form the stable structure. The legs 14 may be moved away from the rods 11 by the links 161 to the open position when the slide 16 is moved downward against the springs 17. The bag 80 may thus be supported in place by the bag holder and may thus be prevented from being inadvertently stepped by the others. In addition, the user may easily fetch the objects received in the bag.

Accordingly, the bag holder in accordance with the present invention may be provided for supporting the bag in place and for allowing the user to easily fetch the object received in the bag.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A holder comprising:

a frame including a pair of rods and including a shaft provided on top of said rods, a support for supporting an object, said support including an upper end pivotally coupled to said shaft and including a lower end having a pair of openings, and a stay including a pair of barrels slidably engaged on said rods and an axle secured between said barrels, a coupler pivotally coupled to said axle, and a pair of beams having a first end pivotally coupled to said coupler and each having a second end, said lower end of said support being caused to move away from said coupler for spacing said second ends of said beams away from each other and for opening said holder to an open position when said barrels are moved downward along said rods.

2. The holder according to claim 1, wherein said rods including an upper end, said frame includes a pair of legs having an upper end pivotally coupled to said upper end of said rods and each having a lower end, and includes means for coupling said lower ends of said legs to said rods.

3. The holder according to claim 2, wherein said frame includes a slide slidably engaged on said rods and adapted to be moved up and down along said rods, and a pair of links pivotally coupling said lower ends of said legs to said slide for allowing said lower ends of said legs to be moved away from said rods when said slide is moved downward along said rods.

4. The holder according to claim 3 further comprising means for biasing said slide upward along said rods and toward said shaft.

5. The holder according to claim 1, wherein said frame includes an upper portion having a stop for engaging with said axle and for retaining said holder in a folded position when said barrels are moved upward toward said shaft.

6. The holder according to claim 1, wherein said lower end of said support includes a stick, said frame includes a lower portion having a retainer for engaging with said stick and for retaining said holder in a folded position when said stick is moved toward said retainer.

7. The holder according to claim 1, wherein said stay includes a bar secured between said barrels, said frame includes a lower end having a hook for engaging with said bar of said stay and for retaining said holder in the open position.

* * * * *